United States Patent [19]

Leibinger et al.

[11] 4,403,205

[45] Sep. 6, 1983

[54] CIRCUIT ARRANGEMENT FOR CONTROLLING TRANSFORMER CURRENT

[75] Inventors: George E. Leibinger; Albert Rowe, both of Pittsfield, Mass.

[73] Assignee: General Electric Company, New York, N.Y.

[21] Appl. No.: 271,465

[22] Filed: Jun. 8, 1981

Related U.S. Application Data

[62] Division of Ser. No. 151,201, May 19, 1980, Pat. No. 4,300,112.

[51] Int. Cl.[3] ..... H01F 27/28

[52] U.S. Cl. ..... 336/180; 336/183

[58] Field of Search ..... 323/346; 336/180, 181, 336/182, 183, 145, 146, 147

[56] References Cited

U.S. PATENT DOCUMENTS

| | | | |
|---|---|---|---|
| 1,347,910 | 7/1920 | Peters | 336/183 X |
| 2,713,667 | 7/1955 | Schwennesen | 336/183 |
| 3,579,165 | 5/1971 | Johnson | 336/183 X |

*Primary Examiner*—Thomas J. Kozma

*Attorney, Agent, or Firm*—Robert A. Cahill

[57] ABSTRACT

A circuit arrangement for power transformers utilizes a series and parallel interconnection of low voltage winding layers to control the impedance between the high voltage winding and the low voltage winding. The division of current between the low voltage parallel winding layers is controlled by adjusting the relative turn distribution between two series connected portions of the low voltage winding.

8 Claims, 6 Drawing Figures

CIRCUIT ARRANGEMENT FOR CONTROLLING TRANSFORMER CURRENT

This is a division of application Ser. No. 151,201, filed May 19, 1980, now U.S. Pat. No. 4,300,112.

BACKGROUND OF THE INVENTION

The arrangement of an interleaved low voltage and high voltage winding wherein the high voltage winding layers are electrically arranged in series and the low voltage winding layers are connected in parallel is disclosed within U.S. Pat. No. 3,895,335. The arrangement of low voltage and high voltage windings as disclosed therein, results in a transformer having a significantly reduced amount of core steel and increased transformer reliability. The winding configuration reduces the radial forces, eddy losses, and stray losses within the transformer. When higher power rated transformers are required however, the division of current between the interleaved low voltage winding layers cannot be completely controlled. Further, the use of this particular winding arrangement with higher power rated transformers is not practical due to the higher current employed and the relatively small number of turns employed within low voltage winding arrangements.

This invention improves over the winding arrangement disclosed within the aforementioned U.S. Patent by providing a plurality of pairs of parallel connected low voltage winding layers wherein the current division between the individual layers can be accurately controlled. The proper division of current within any specific transformer design reduces the transformer reactance and magnetic losses to a minimum value.

The use of series parallel low voltage winding layers is disclosed within U.S. patent application Ser. No. 130,412, now abandoned filed Mar. 14, 1980 (Lamberton). The Lamberton low voltage winding arrangement comprises a "Form S" type high voltage winding wherein all the low voltage winding layers are surrounded by the high voltage winding layers. This is accomplished by first winding the first high voltage winding layer, winding all the low voltage winding layers and then winding the final high voltage winding layer. The Lamberton winding layer configuration differs from that within aforementioned U.S. Pat. No. 3,895,335 in that a series parallel arrangement of low voltage winding layers is located between the inner and outer parts of a high voltage winding.

The instant invention distinguishes over the Lamberton winding arrangement, as well as the arrangement disclosed within the aforementioned U.S. Patent, by providing a "Form S" type high voltage winding, and a "Form S" type low voltage winding with control of current Division in parallel circuits.

A "Form S" type winding is described herein as consisting of an inner and outer part of one winding that surrounds a portion of another winding.

SUMMARY OF THE INVENTION

The invention comprises a plurality of low voltage and high voltage winding layers around a transformer core with the high voltage layers connected in series and the low voltage layers connected in series parallel. The series connected portion of the low voltage winding surrounds a portion of the high voltage winding so that the current division between the low voltage parallel circuits can be directly controlled by adjusting the turn distribution between the series connected portions of the low voltage winding.

DESCRIPTION OF THE PREFERRED EMBODIMENT

Figure 1:
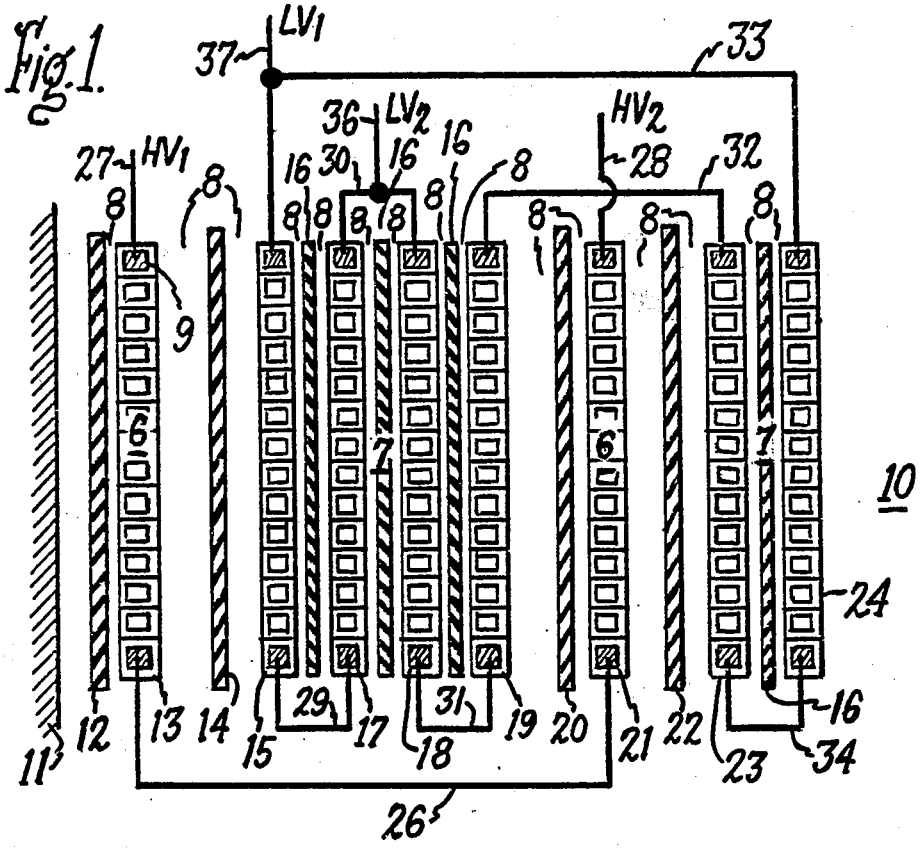
FIG. 1 is a side sectional view of the winding arrangement of the invention.

The winding arrangement of the invention 10 consisting of high and low voltage windings 6, 7, can be seen by referring to FIG. 1 wherein a transformer core leg 11 is encompassed by an insulating winding cylinder 12 and a high voltage winding layer 13 consisting of a plurality of turns of insulated transformer cable 9, is disposed around winding cylinder 12 and constitutes the inner portion of high voltage winding 6. A layer of insulating paper 14 is provided on high voltage layer 13 before winding a first low voltage winding layer 15. Although the term "layers" is used for depicting the arrangement of the invention, other types of winding configurations such as disks and foil type windings can also be employed. The layers are considered as parts of the low voltage winding and as portions of the high voltage winding for purposes of the specific embodiments disclosed herein. The insulation 14 is arranged in such a manner as to leave oil cooling ducts 8 between first high voltage layer 13 and first low voltage layer 15 to ensure the presence and transport of insulating dielectric oil. A thinner wrapping of insulating paper 16 is provided around first low voltage winding layer 15 to ensure the presence and transport of insulating dielectric oil. A thinner wrapping of insulating paper 16 is provided around first low voltage winding layer 15, and a second low voltage winding layer 17 is then wrapped around transformer core leg 11 a further radial distance away from core leg 11 than first high voltage winding layer 13 and first low voltage winding layer 15. A layer of insulating paper 16 is wrapped around second low voltage winding layer 17, and a third low voltage winding layer 18 is then wrapped around insulating paper 16. Another layer of insulating paper 16 is provided around third low voltage winding layer 18, and a fourth low voltage winding layer 19 is then wrapped around insulating paper 16. A heavy wrapping of insulating paper 20, designed to provide cooling ducts 8 is provided between fourth low voltage winding layer 19 and a second high voltage winding layer 21 which constitutes the "outer" portion of high voltage winding 6. A thick layer of insulating paper 22 is provided between second high voltage winding layer 21 and fifth low voltage winding layer 23 is arranged to provide oil cooling ducts 8, and a layer of insulating paper 16 separates sixth low voltage winding layer 24 from fifth low voltage winding layer 23. The electrical interconnections between the high voltage and low voltage winding layers (13, 21) and (15, 17, 18, 19, 23,24) respectively, are as follows. First high voltage winding layer 13 is electrically connected in series with second high voltage winding layer 21 by means of connector 26. Electrical connection between high voltage winding layer 13 is made by means of a first high voltage terminal $HV_1$ and terminal lead 27, and with second high voltage winding layer 21 by means of a second high voltage terminal $HV_2$ and second terminal lead 28. First low voltage winding layer 15 is electrically connected in series with second low voltage winding layer 17 by means of connector 29, and electrical connection between second low voltage winding layer 17 and third low voltage winding layer 18 is made by means of connector 30. Third low voltage winding layer 18 is electrically connected in series with fourth low voltage winding layer 19 by means of connector 31 and electrical connection between fourth low voltage winding layer 19 and fifth low voltage winding layer 23 is made by means of connector 32. Electrical connections between first low voltage winding layer 15 and sixth low voltage winding layer 25 is made by connector 33. Fifth low voltage winding layer 23 is electrically connected in series with sixth low voltage winding layer 24 by means of connector 34. Terminal lead 37 connects with first low voltage terminal $LV_1$ and terminal lead 36 connects with second low voltage terminal $LV_2$ for low voltage winding layers 15, 17, 18, 19, 23, and 24.

Figure 2:
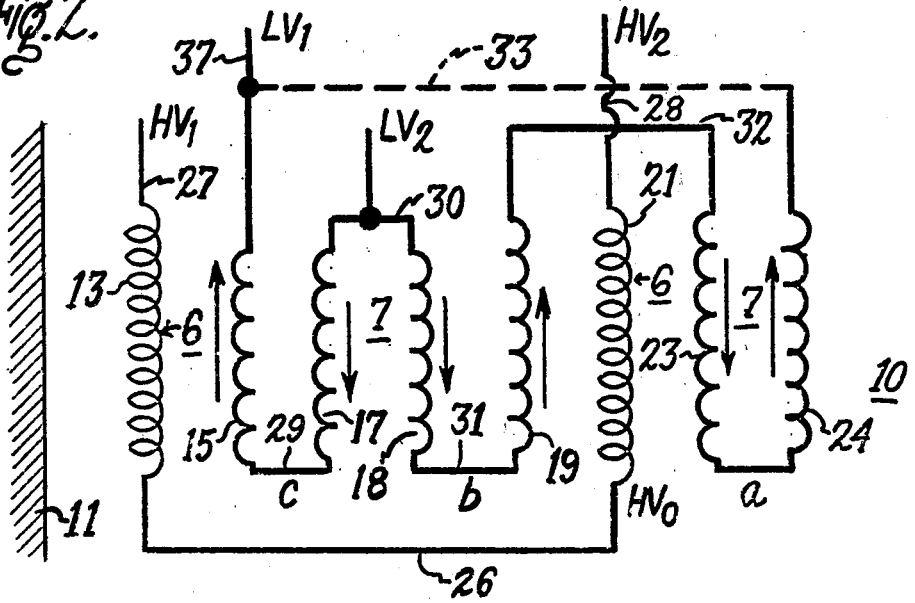
FIG. 2 is a schematic representation of the winding arrangement of FIG. 1.

The electrical relationship between low voltage winding layers 15, 17, 18, 19, 23, and 24 is shown in FIG. 2 wherein the direction of current flow is indicated by arrows. The winding layers are arranged as parallel circuit pairs in the following manner. Fifth low voltage winding layer 23 and sixth low voltage winding layer 24, comprise the first parallel circuit pair designated a. Third low voltage winding layer 18 and fourth low voltage winding layer 19 comprise the second parallel circuit pair b, and first low voltage winding layer 15 and second low voltage winding layer 17 comprise third parallel circuit pair c.

Parallel circuit pairs a, b, and c are arranged such that a b are in electrical series with each other and in parallel with c. The number of wire turns comprising parallel circuit a includes the number of wire turns employed within sixth low voltage winding layers 24, and the number of wire turns employed within fifth low voltage winding layer 23. Parallel circuit pair b includes the number of wire turns which comprise fourth low voltage winding layer 19 and third low voltage winding layer 18. The total number of wire turns that comprise circuits a and b are made equal to the number of wire turns that comprise third parallel circuit pair c which includes the number of wire turns that make up second low voltage winding layer 17 and first low voltage winding layer 15. Connector 33 is depicted in dotted lines in order to more clearly illustrate the series circuit relation between a and b which includes low voltage winding layers 24,23, 19 and 18.

Figure 3:
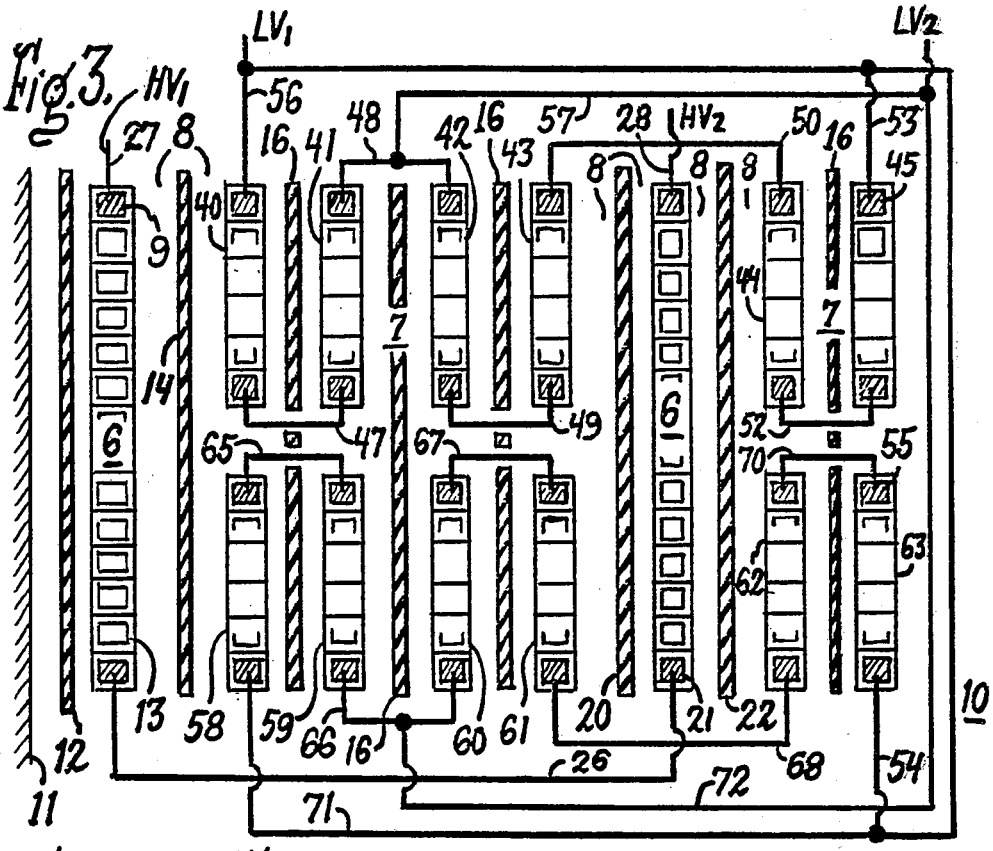
FIG. 3 is a side sectional view of an alternate embodiment of the winding arrangement of the invention.

Another low voltage winding arrangement 10, according to the invention, is shown in FIG. 3 wherein like reference numerals will be employed to depict like portions of the winding structure as well as the high voltage winding layers. A transformer core leg 11 is surrounded by an insulated winding cylinder 12, and the first high voltage winding layer 13, consisting of a plurality of turns 9 of insulated transformer cable, is arranged around winding cylinder 12 and transformer core leg 11. A separating layer of insulating paper 14 has a configuration such that oil cooling ducts 8 are provided between first high voltage winding layer 13 and the top part of first low voltage winding layer 40. A layer of insulating paper 16 separates the top part of first low voltage winding layer 40 from the top of second low voltage winding layer 41. The top part of third low voltage winding layer 42 is separated from the top part of the second low voltage winding layer 41 by a layer of paper insulation 16 and the top part of fourth low voltage winding layer 43 is separated from the top part of the third low voltage winding layer 42 by a layer of insulating paper 16. A heavy layer of insulating paper 20 is used for insulating the top part of fourth low voltage winding layer 43 from second high voltage winding layer 21 and to form oil cooling ducts 8. A heavy layer of insulating paper 22 is wrapped around second high voltage winding layer 21 and serves to separate high voltage winding layer 21 from the top part of the fifth low voltage winding layer 44 and to form oil cooling ducts 8. The top and bottom parts of fifth low voltage winding layer 44, 62 and the top and bottom parts of sixth low voltage winding layers 45,63 are separated from each other by means of paper insulation 16. The electrical interconnection of the top part of the winding arrangement 10 is as follows. The top part of the first low voltage winding layer 40 is electrically connected in series with the top part of the second low voltage winding layer 41 by means of conductor 47. The top part of the third low voltage winding layer 42 is electrically connected with the top part of the second low voltage winding layer 41 by means of connector 48. The top part of the third low winding layer 42 is electrically connected in series with the top part of the fourth low voltage winding layer 43 by means of connector 49. Connector 50 connects the top part of the fifth low voltage winding layer 44 in electrical series with the top part of the fourth low voltage winding layer 43, and connector 52 connects the top part of the sixth low voltage winding layer 45 electrically in series with the top part of the fifth low voltage winding layer 44. Electrical connection is made between the first low voltage winding terminal $LV_1$ and the top part of the first low voltage winding layer 40 by means of electrical connector 56. Electrical connection between the top part of the sixth low voltage winding layer 45 and first low voltage winding terminal $LV_1$ is made by means of connector 53 and part of connector 71. Electrical connection between second low voltage terminal $LV_2$, the top part of second low voltage winding layer 41 and the top part of the third low voltage winding layer 42 is made by means of electrical connectors 57 and 48.

The bottom part of winding arrangement 10 is arranged as follows. The bottom part of the first low voltage winding layer 58 is separated from first high voltage winding layer 13 by means of a layer of heavy insulating paper 14 in the manner and at the same radial distance from core leg 11 as the top part of the first low voltage winding layer 40. The same paper insulating layer 16 that separates the top part of the second low voltage winding layer 41 from the top part of the first low voltage layer 40, also separates the bottom part of the second low voltage winding layer 59 from the bottom part of the first low voltage winding layer 58. The bottom part of the third low voltage winding layer 60 is separated from the bottom part of the fourth low voltage winding layer 61 by means of a layer of insulating paper 16. The bottom part of the fourth low voltage winding layer 61 is arranged around the insulating paper 16 that separates the bottom of the third low voltage winding layer 60. The bottom part of the fifth low voltage winding layer 62 is arranged around the large thickness of insulating paper 22 that also separates the top part of the fifth low voltage winding layer 44 from the second high voltage winding layer 21. The bottom part of the sixth low voltage winding layer 63 is separated from the bottom part of the fifth low voltage winding layer 62 by means of a layer of paper insulation 16.

The electrical interconnection between the bottom low voltage winding layers 58–63 is as follows. The bottom part of the first low voltage winding layer 58 is connected in series with the bottom part of the second low voltage winding layer 59 by means of connector 65, and the bottom part of the second low voltage winding layer 59 is electrically connected to the bottom part of the third low voltage winding layer 60 by means of connector 66. The bottom part of the third low voltage winding layer 60 is electrically connected in series with the bottom part of the fourth low voltage winding layer 61 by means of connector 67, and the bottom part of the fourth low voltage winding layer 61 is electrically connected in series with the bottom part of the fifth low voltage winding layer 62 by means of connector 68. The bottom part of the sixth low voltage winding layer 63 is electrically connected in series with the bottom part of the fifth low voltage winding layer 62 by means of connector 70. The bottom part of the sixth low voltage winding layer 63 is electrically connected in series with the bottom part of the fifth low voltage winding layer 62 by means of connector 70. The bottom part of the sixth low voltage winding layer 63 is electrically connected with the first low voltage winding terminal $LV_1$ by means of connector 54 and part of connector 71. The bottom part of the first low voltage winding layer 58 is directly connected with the first low voltage winding terminal $LV_1$ by means of connector 71. The bottom parts of the second low voltage winding layer 59 and the third low voltage winding layer 60 are both connected to the second low voltage winding terminal $LV_2$ by means of connectors 66 and 72. The bottom part of the fourth low voltage winding layer 61 is electrically connected in series with the bottom part of the fifth low voltage winding layer 62 by means of connector 68.

Figure 4:
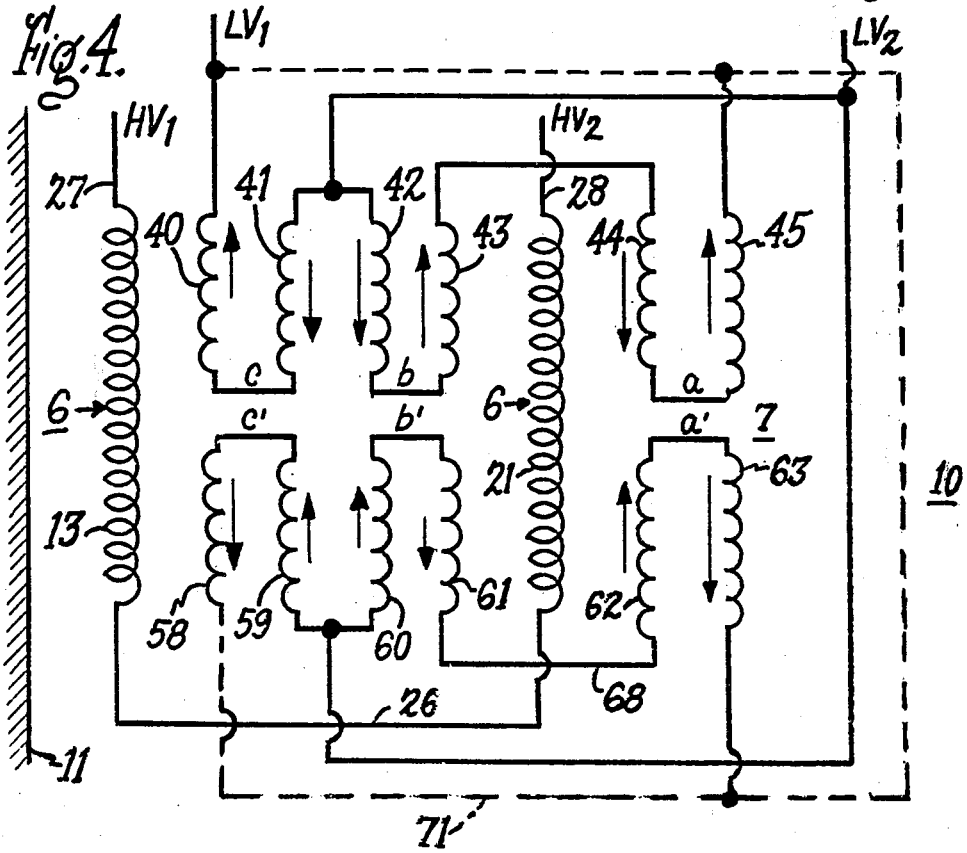
FIG. 4 is a schematic representation of the winding arrangement of FIG. 3.

The electrical interrelationship between the top parts of the layers 40–45 for the embodiment depicted in FIG. 3 is shown in FIG. 4. The current flow through each of the winding layers 40–45 is indicated by arrows. Parallel circuit pair a consists of the top part of the fifth low voltage winding layer 44 and the top part of the sixth low voltage winding layer 45 electrically connected in series. Parallel circuit pair b consists of the top parts of the third and fourth low voltage winding layers 42 and 43. Parallel circuit pair consists of the top parts of the first and second low voltage winding layers 40 and 41. The number of turns in parallel circuit pair c is designed to equal the total number of wire turns employed in circuits b and a. The parallel circuit pairs a′, b′, c′, constituting the bottom parts of the first, second, third, fourth, fifth and sixth low voltage winding layers 58–63, are arranged as a mirror image of the parallel circuit pairs a, b, c, constituting the top part of the first second, third, fourth, fifth and sixth winding layers 40–45. The parallel circuit pair a′ comprising the bottom part of the fifth low voltage winding layer 62 and the bottom part of the sixth low voltage winding layer 63, is in series with the bottom parallel circuit pair b′ consisting of the bottom part of the fourth low voltage winding layer 61 and the bottom part of the third low voltage winding layer 60, and connector 68. Bottom parallel circuit pairs a′, b′, are electrically connected in parallel with bottom parallel circuit pair c′, consisting of the bottom part of the first low voltage winding layer 58 and the bottom part of the second low voltage winding layer 59. Connector 71, which connects between the bottom part of the first low voltage winding layer 58 and the first low voltage terminal $LV_1$ is indicated in dotted lines. First and second high voltage winding layers 13 and 21 comprising high voltage winding 6 are shown disposed within low voltage winding 7 in a "Form S" type winding configuration, and are electrically connected in series by means of connector 26. Electrical connection is made with the high voltage winding layers 13 and 21 by means of first and second high voltage terminals $HV_1$ and $HV_2$.

Figure 5:
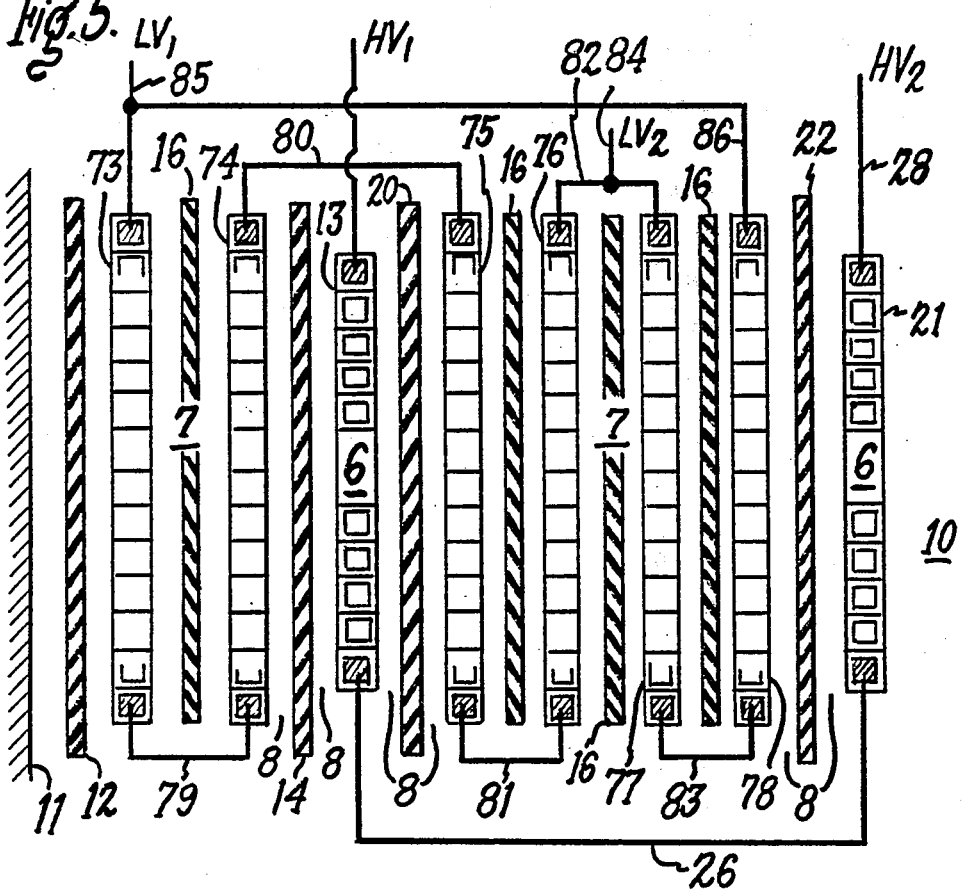
FIG. 5 is a side sectional view of a further embodiment of the winding arrangement of the invention.

A further embodiment of the winding arrangement 10 of the invention is shown in FIG. 5 wherein like reference numerals will be employed to depict like portions of the winding structure and high voltage winding layers described within the earlier embodiment of FIGS. 1–4. A first low voltage winding layer 73 is disposed around an insulating cylinder 12 surrounding core leg 11.

Second low voltage winding layer 74 is separated from first low voltage winding layer 73 by means of a layer of insulating paper 16. A heavy layer of insulating paper 14, arranged to provide oil cooling ducts 8, separates second low voltage winding layer 74 from first high voltage winding layer 13 and a separate, heavy layer of insulating paper 20, arranged to provide cooling oil ducts 8, separates first high voltage winding layer 13 from third low voltage winding layer 75. Fourth low voltage winding layer 76 is separated from third low voltage winding layer 75, by means of a layer of insulating paper 16 and fifth low voltage winding layer 77 is arranged around fourth low voltage winding layer 76 with an intervening wrapping of insulating paper 6. Sixth low voltage winding layer 78 is arranged around fifth low voltage winding layer 77 with an intervening layer of insulating paper 16. A heavy layer of insulating paper 22, arranged to provide cooling oil ducts 8, separates second high voltage winding layer 21 from the sixth low voltage winding layer 78. First low voltage winding layer 73 is electrically connected in series with second low voltage winding layer 74 by means of connector 79. First high voltage winding layer 13 is electrically connected in series with second high voltage winding layer 21 by means of connector 26. Second low voltage winding layer 74 is electrically connected in series with third low voltage winding layer 75 by means of connector 80, and fourth low voltage winding layer 76 is electrically connected in series with third low voltage winding layer 75 by means of connector 81. Fifth low voltage winding layer 77 is electrically connected to fourth low voltage winding layer 76 by means of connector 82. Sixth low voltage winding layer 78 is electrically connected in series with fifth low voltage winding layer 77 by means of connector 83. Electrical connection with second low voltage terminal $LV_2$ is made between fourth low voltage winding layer 76 and fifth low voltage winding layer 77 by means of connectors 82 and 84. Electrical connection between first low voltage winding layer 73 and first low voltage winding terminal $LV_1$ is made by means of connector 85. Electrical connection between sixth low voltage winding layer 78 and first low voltage terminal $LV_1$ is made by means of connector 86.

Figure 6:
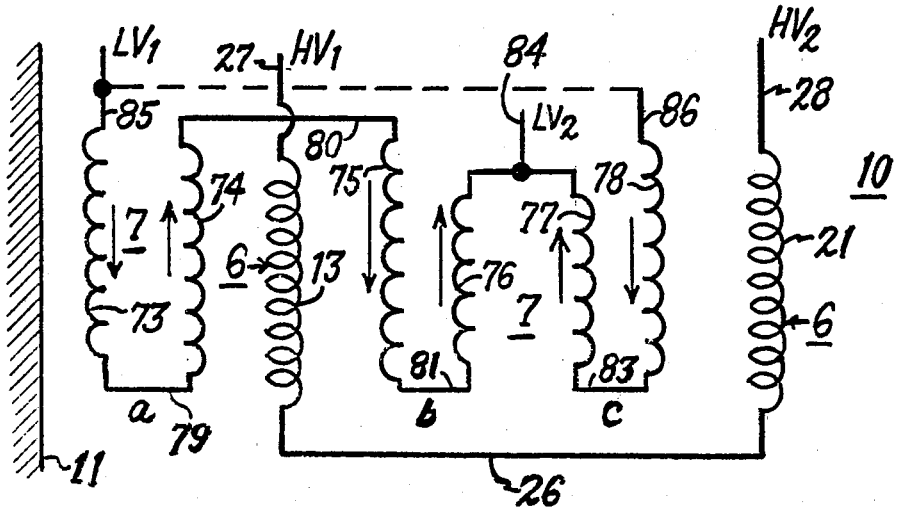
FIG. 6 is a schematic representation of the winding arrangement of FIG. 5.

The electrical relationship for the embodiment depicted in FIG. 5 is shown in FIG. 6. The direction of current flow through low voltage winding layers 73–78 is shown by directional arrows. First low voltage winding layer 73, disposed around core leg 11, and second low voltage winding layer 74, electrically connected in series with first low voltage winding layer 73 by means of connector 79, forms a first parallel circuit pair a. A second parallel circuit pair b consisting of third low voltage winding layer 75 and fourth low voltage winding layer 76 connected in series by means of connector 81, is electrically connected in series with first parallel circuit pair a by means of connector 80. Third parallel circuit pair c, consisting of fifth low voltage winding layer 77 and sixth low voltage winding layer 78 connected by means of connector 83 is electrically connected in parallel with parallel circuit pairs a and b in a manner similar to that described for the embodiment depicted in FIG. 2. The total number of wire turns employed within the parallel circuit pair c equals the total number of wire turns employed within both parallel circuit pairs a and b.

In some transformer designs it is more desirable to locate the entire high voltage winding 6 within the low voltage winding 7. This is accomplished with the circuits of FIGS. 2 and 4 by locating first high voltage winding layer 13 next to second high voltage winding layer 21. This is accomplished with the circuit of FIG. 6 by locating second high voltage layer 21 next to first high voltage winding layer 13, rather than outside low voltage winding 7 as shown.

What we claim as new and desire to secure by Letters Patent of the Unites States is:

1. A winding arrangement for controlling transformer current comprising:

a core 11;

a first 6 and a second 7 winding in electromagnetic relation with said core 11;

a first part 73–74 of a second winding 7 arranged around said core 11;

an inner part 13 of a first winding 6 arranged around said first part 73,74 of said second winding 7;

a second part 75,76 and a third part 77,78 of said second winding 7 arranged between said inner part 13 of said first winding 7 and an outer part 21 of said first winding 6, said inner part 13, and said outer part 21 of said first winding 6 being electrically connected in series, said first part 73–74 and said second part 75,76 of said second winding 7 being electrically connected in series; and said first part 73,74 and said second part 75, 76 of said second winding 7 having a plurality of wire turns equal to a corresponding number of wire turns within said third parts 77,78 of said second winding 7 for distributing transformer current within said second winding 7.

2. The arrangement of claim 1 wherein third part 77,78 of said second winding 7 is electrically connected in parallel with said first part 73,74 and said second part 75,76 of said second winding 7.

3. The arrangement of claim 1 wherein said first winding comprises a high voltage winding and said second winding comprises a low voltage winding.

4. The arrangement of claim 1 wherein said first, second, and third parts 73–74, 75–76, 77–78, of said second winding each comprise at least two layers of transformer coil.

5. A winding arrangement for controlling transformer current comprising:

a transformer core 11;

a first winding 6 arranged around said core and consisting of a pair of first and second portions 13, 21 electrically connected in series;

first 73–74, second 75–76, and third 77–78 parts of a second winding 7 arranged around said first winding 6, said first and second parts 73–74, 75–76, being electrically connected in series and containing a plurality of wire turns equal to a corresponding number of wire turns within said third part 77–78 for distributing transformer current within said second winding 7.

6. The transformer of claim 5 wherein said first and second parts 73–74, 75–76, of said second winding 7 are electrically connected in parallel with said third parts 77–78 of said second winding 7.

7. The transformer of claim 5 wherein said first, second, and third parts, 73–74, 75–76, 77–78 of said second winding 7 each comprise at least two layers of transformer cable electrically connected in series with each other.

8. The transformer of claim 5 wherein said first winding comprises a high voltage winding and said second winding comprises a low voltage winding.

* * * * *